US008786507B2

(12) United States Patent
Ayatollahi

(10) Patent No.: US 8,786,507 B2
(45) Date of Patent: Jul. 22, 2014

(54) ANTENNA ASSEMBLY UTILIZING METAL-DIELECTRIC STRUCTURES

(75) Inventor: Mina Ayatollahi, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 448 days.

(21) Appl. No.: 13/095,338

(22) Filed: Apr. 27, 2011

(65) Prior Publication Data

US 2012/0274527 A1 Nov. 1, 2012

(51) Int. Cl.
*H01Q 13/10* (2006.01)

(52) U.S. Cl.
USPC ..... 343/770; 343/725; 455/550.1; 455/575.1

(58) Field of Classification Search
USPC ..... 343/770, 725; 455/550.1, 575.1
See application file for complete search history.

(56) References Cited

U.S. PATENT DOCUMENTS

| | | | | |
|---|---|---|---|---|
| 5,557,293 | A * | 9/1996 | McCoy et al. | 343/867 |
| 6,346,919 | B1 * | 2/2002 | Wang et al. | 343/767 |
| 7,042,419 | B2 | 5/2006 | Werner et al. | |
| 7,215,301 | B2 | 5/2007 | Choi et al. | |
| 7,352,328 | B2 | 4/2008 | Moon et al. | |
| 7,375,685 | B1 * | 5/2008 | Nalbandian | 343/700 MS |
| 7,586,444 | B2 | 9/2009 | Berlin et al. | |
| 7,760,140 | B2 | 7/2010 | Kamgaing | |
| 7,764,149 | B2 | 7/2010 | Han et al. | |
| 7,773,033 | B2 | 8/2010 | Morton et al. | |
| 8,115,682 | B2 * | 2/2012 | Chang et al. | 343/700 MS |
| 2001/0020920 | A1 * | 9/2001 | Shigihara | 343/732 |
| 2002/0196190 | A1 * | 12/2002 | Lim | 343/700 MS |
| 2004/0252058 | A1 * | 12/2004 | Rawnick et al. | 343/700 MS |
| 2005/0170858 | A1 * | 8/2005 | Tao | 455/550.1 |
| 2005/0223286 | A1 * | 10/2005 | Forster | 714/25 |
| 2005/0245234 | A1 * | 11/2005 | Stopek | 455/411 |
| 2006/0044188 | A1 * | 3/2006 | Tsai et al. | 343/700 MS |
| 2006/0125713 | A1 | 6/2006 | Thevonot et al. | |
| 2009/0109096 | A1 * | 4/2009 | Hozouri | 343/700 MS |
| 2009/0153410 | A1 * | 6/2009 | Chiang et al. | 343/702 |

(Continued)

FOREIGN PATENT DOCUMENTS

GB 2360132 A 9/2001

OTHER PUBLICATIONS

Sun, et al., "Electromagnetic Bandgap Enhancement Using the High-Impedance Property of Offset Finite-Ground Microstrip Line," Microwave and Optical Technology Letters, Vo. 47, No. 6, pp. 543-546, Dec. 20, 2005.

(Continued)

*Primary Examiner* — Allyson Trail
(74) *Attorney, Agent, or Firm* — Quarles & Brady LLP

(57) ABSTRACT

An antenna assembly for a wireless communication device includes a substrate of dielectric material that has opposing first and second surfaces. A ground plane formed by a layer of electrically conductive material on the first surface. An antenna with a physical length is disposed on the substrate. At least one metal-dielectric structure is disposed on the substrate. The metal-dielectric structures resonate so as to interact with the antenna and thereby alter the effective electrical length of the antenna. That interaction causes the antenna to function as though it had a greater physical length. In one embodiment, that interaction enables an antenna, that is shorter than one-fourth the wavelength of a radio frequency signal applied thereto, to function as through the physical length of the antenna was one-fourth that wavelength.

23 Claims, 4 Drawing Sheets

(56) References Cited

U.S. PATENT DOCUMENTS

| | | | | |
|---|---|---|---|---|
| 2010/0117891 | A1* | 5/2010 | Utagawa et al. | 342/175 |
| 2010/0123630 | A1* | 5/2010 | Chou | 343/700 MS |
| 2012/0196556 | A1* | 8/2012 | Perrott et al. | 455/404.1 |
| 2013/0229322 | A1* | 9/2013 | Wang | 343/866 |

OTHER PUBLICATIONS

Chou, et al., "Investigations of Isolation Improvement Techniques for Multiple Input Multiple Output (MIMO) WLAN Portable Terminal Applications," Progress in Electromagnetics Research, PIER 85, pp. 349-366, 2008.

Baee, et al., Using of CSRR and its Equivalent Circuit Model in Size Reduction of Microstrip Antenna, Microwave Conference 2007, APMC 2007, Asia-Pacific, Dec. 11, 2007, pp. 1-4.

Ma, et al., Design the size reduction patch antenna based on complementary split ring resonators, Microwave and Millimeter Wave Technology (ICMMT), 2010 International Conference, May 8, 2010, pp. 401-402.

Jing Liang, et al., Microstrip patch antennas on tunable electromagnetic band-gap substrates, IEEE Transactions on Antennas and Propagation, vol. 57, No. 6, Jun. 2009, pp. 1612-1617.

Sanz-Izquierdo, et al., Dual-Band Tunable Screen Using Complementary Split Ring Resonators, IEEE Transactions on Antennas and Propagation, vol. 58, No. 11, Nov. 1, 2010, pp. 3761-3765.

Gregorwich, The design and development of frequency selective surfaces for phased arrays, Aerospace Conference, IEEE Snowmass, Aspen, Colorado, proceedings, vol. 5, Mar. 1999, pp. 471-479.

* cited by examiner

ANTENNA ASSEMBLY UTILIZING METAL-DIELECTRIC STRUCTURES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

The present disclosure relates generally to antennas for portable, handheld communication devices, and more particularly to designing an antenna for operation at specific radio frequencies.

Different types of wireless mobile communication devices, such as personal digital assistants, cellular telephones, and wireless two-way email communication equipment, cellular smart-phones, wirelessly enabled notebook computers, are available. Many of these devices are intended to be easily carried on the person of a user, often compact enough to fit in a shirt or coat pocket.

As the use of wireless communication equipment continues to increase dramatically, a need exists for increased system capacity. One technique for improving the capacity is to provide uncorrelated propagation paths using Multiple Input, Multiple Output (MIMO) systems. A MIMO system employs a number of separate independent signal paths, for example by means of several transmitting and receiving antennas.

MIMO systems, employing multiple antennas at both the transmitter and receiver offer increased capacity and enhanced performance for communication systems without the need for increased transmission power or bandwidth. The limited space in the enclosure of the mobile communication device, however presents several challenges when designing such multiple antennas assemblies. An antenna should be compact to occupy minimal space and its location is critical to minimize performance degradation due to electromagnetic interference. Bandwidth is another consideration that the antenna designers face in multiple antenna systems.

The size of the antenna is dictated by the radio frequency or band of frequencies at which the antenna is intended to resonate and operate Typically, the physical length of the antenna is a fraction of the wavelength of the operating frequency, for example one-fourth or one-half the wavelength of the radio frequency signal, thus enabling the antenna to resonate at the respective operating frequency. The required physical size for the antenna, to resonate at a certain frequency, is known as the resonant length. For example, an antenna which requires a length equal to quarter of the wavelength of the resonance frequency is known to have a resonant length of a quarter of a wavelength. This size requirement limits how small the antenna can be constructed and thus the amount of space in the housing of the mobile communication device that is occupied by the antenna.

Nevertheless, it is desirable to further reduce the size of the antenna so it can be fit in the small space designated for the antenna in the communication device, especially when the communication device has multiple antennas.

DETAILED DESCRIPTION

Figure 1:
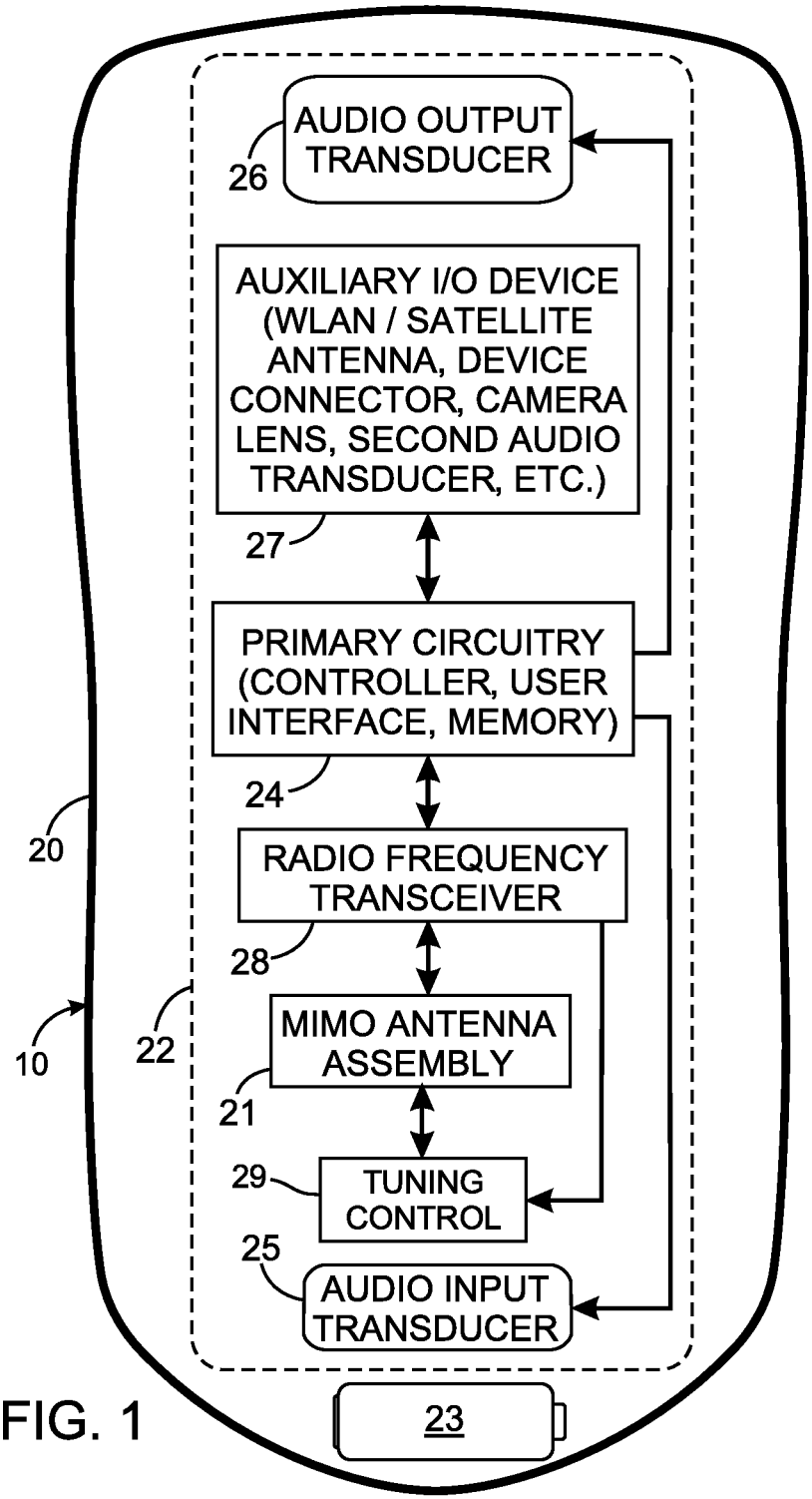
FIG. 1 is a schematic block diagram of a mobile, wireless communication device that incorporates the present antenna assembly.

The present antenna array for communication devices provides a mechanism for altering the effective electrical size of an antenna so that the antenna can have a smaller physical size and still be tuned to a desired radio frequency. The exemplary antenna assembly has two identical radiating elements, which in the illustrated embodiments, comprise slot (gap) antennas or inverted-F antennas. It should be understood, however, that other types of radiating elements can be tuned using the techniques and structures described herein. Also, the antenna assembly can have a single radiating element or more than two radiating elements.

The embodiments of the antenna array described herein have a printed circuit board (PCB) with a first major surface with an electrically conductive layer thereon to form a ground plane At least one antenna is disposed on that first major surface. For example, a pair slot antennas are formed by two straight, open-ended slots at two opposing edges of that conductive layer. The slots are located along one edge of the PCB opposing each other. The dimensions of the slots, their shape and their location with respect to the any edge of the PCB can be adjusted to optimize the resonance frequency, bandwidth, impedance matching, directivity, and other antenna performance parameters. Each antenna in this configuration operates with a relatively wide bandwidth. Furthermore the slots may be tuned to operate at different frequencies using micro-electromechanical systems (MEMS), for example by opening or closing conductive bridges across a slot. The opposite side of the PCB is available for mounting other components of the communication device.

One or more metal-dielectric structures are formed either in the conductive layer on the first major surface of the PCB or on the opposite second major surface. Each metal-dielectric structure resonates at a frequency in the bandwidth of radio frequency signals to be transmitted or received by the antenna. These metal-dielectric structures are placed around and underneath the antenna on the ground plane at locations where a high current density exists. Thus the structures are strategically placed only at locations where they are effective for tuning the antennas. The placement of one or more metal-dielectric structures at such locations adjacent the antenna enables the antenna to have a smaller physical size than it is required for the antenna to resonate at its resonant frequency.

In particular, these structures can allow the antenna to be physically smaller than its resonant length at a particular frequency, and still efficiently transmit or receive radio signals at that frequency.

When the antenna can be tuned to different operating frequencies, a mechanism for corresponding tuning the metal-dielectric structures also is provided.

Examples of specific implementations of the present antenna assembly now will be provided. For simplicity and clarity of illustration, reference numerals may be repeated among the figures to indicate corresponding or analogous elements. In addition, numerous specific details are set forth in order to provide a thorough understanding of the embodiments described herein. The embodiments described herein may be practiced without these specific details. In other instances, well-known methods, procedures and components have not been described in detail so as not to obscure the embodiments described herein. Also, the description is not to be considered as limited to the scope of the embodiments described herein.

Referring initially to FIG. 1, a mobile, wireless communication device 10, such as a cellular telephone, illustratively includes a housing 20 that may be a static housing or a flip or sliding housing as used in many cellular telephones. Nevertheless, other housing configurations also may be used. A battery 23 is carried within the housing 20 for supplying power to the internal components.

The housing 20 contains a main printed circuit board (PCB) 22 on which the primary circuitry 24 for the wireless communication device 10 is mounted. That primary circuitry 24, typically includes a microprocessor, one or more memory devices, along with a display and a keyboard that provide a user interface for controlling the communication device.

An audio input transducer, such as a microphone 25, and an audio output transducer, such as a speaker 26, function as an audio interface to the user and are connected to the primary circuitry 24.

Communication functions are performed through a radio frequency transceiver 28 which includes a wireless signal receiver and a wireless signal transmitter that are connected to a MIMO antenna assembly 21. The antenna assembly 21 may be carried within the upper portion of the housing 20 and will be described in greater detail herein.

The mobile wireless, device 10 also may comprise one or more auxiliary input/output (I/O) devices 27, such as for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position locating capabilities, as will be appreciated by those skilled in the art. Other examples of auxiliary I/O devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 2:
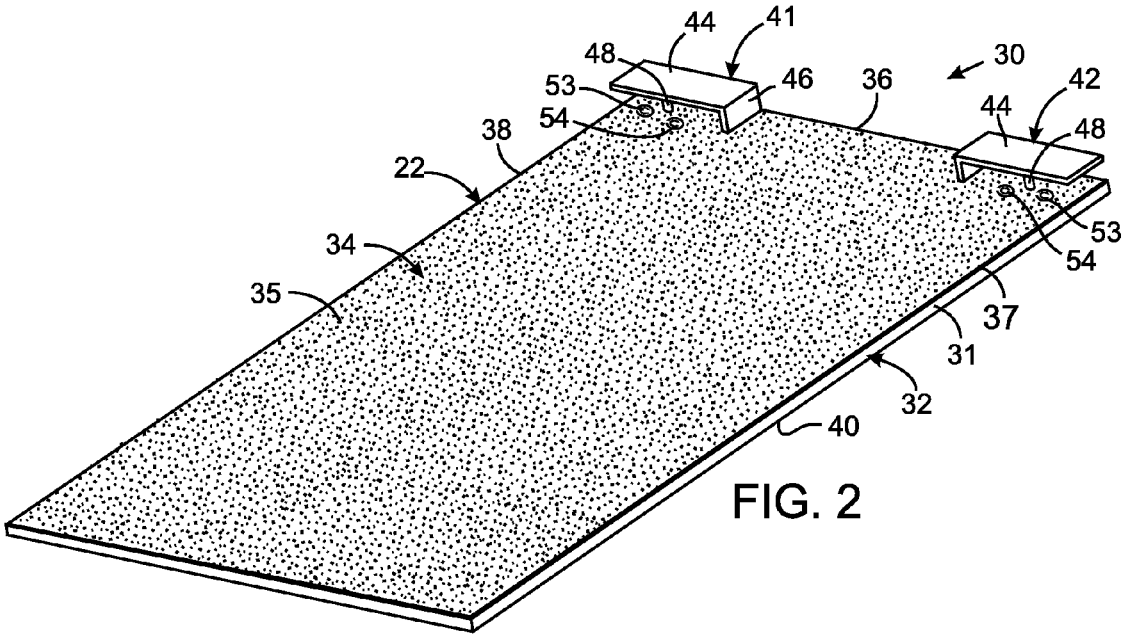
FIG. 2 is pictorial view of a printed circuit board on which a first version of a multiple antenna assembly is formed.

FIG. 2 illustrates an exemplary a first antenna assembly 30 that can be used as the MIMO antenna assembly 21. The first antenna assembly 30 is formed on a printed circuit board 32 that has a non-conductive substrate 31 of a dielectric material with a first major surface on which an electrically conductive layer 34 is applied to form a ground plane 35. The substrate 31 and likewise the conductive layer 34 have a first edge 36 and second and third edges 37 and 38 that are orthogonal to the first edge. First and second antennas 41 and 42 are located along the first edge 36 and extend inwardly from the opposite second and third edges 37 and 38.

Each antenna 41 and 42 is an inverted-F type formed by a radiating element 44 that is parallel to and spaced from the conductive layer 34. A shorting element 46 is connected between the inner end of the radiating element 44 and the conductive layer 34. A signal feed pin 48 extends from a central area of the radiating element 44 through an aperture in the printed circuit board 32 and is connected to the radio frequency transceiver 28. The first and second antennas 41 and 42 oppose each other across a width of the ground plane 35 and may have substantially identical shapes.

Although the present apparatus is being described in the context of an assembly of two antennas, it should be appreciated that the assembly can have a single antenna or a greater number of antennas.

Figure 3:
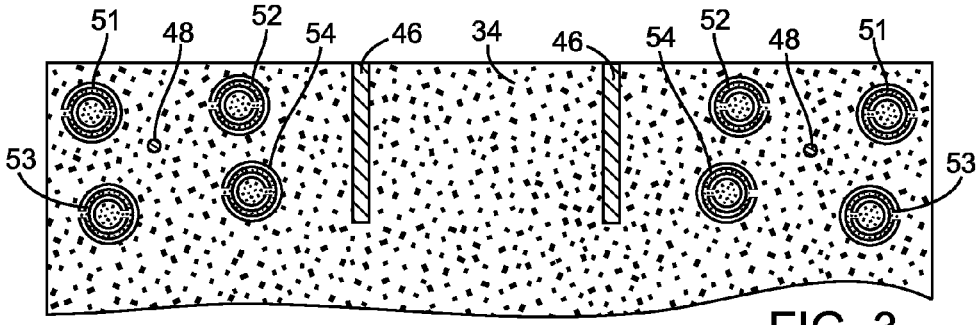
FIG. 3 is an enlarged view a portion of one side of a printed circuit board in FIG. 2.

With additional reference to FIG. 3, a separate set of four identical metal-dielectric structures 51, 52, 53 and 54 are located on the ground plane 35 adjacent the signal feed pin 48 of each of the first and second antennas 41 and 42. In the exemplary illustrated arrangement the four identical metal-dielectric structures 51-54 are located around the feed pin 48 at least partially underneath the associated radiating element 44.

Each metal-dielectric structure 51-54 is placed at a location on the ground plane 35 that has a high current density as determined from the emission pattern of the two antennas 41 and 42. Those locations in the ground plane are places having the maximum current density level or a current density that is at least some percentage of the maximum current density level, such as at least eighty percent. Note that locating the metal-dielectric structures 51-54 based on this criterion does not necessarily form a periodic array, i.e., the spacing between adjacent pairs of the metal-dielectric structures is not identical. It should be understood that the number and location of these metal-dielectric structures 51-54 in the drawings is for illustrative purposes and may not denote the actual number and locations for a given antenna assembly design.

Figure 5:
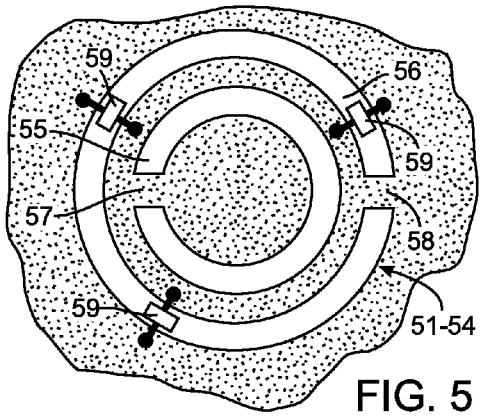
FIG. 5 is a detailed view of one metal-dielectric structure in FIG. 3.

As shown in detail in FIG. 5, the metal-dielectric structures 51-54 in the embodiment of FIG. 2 comprise a frequency selective surface formed by two concentric rings 55 and 56 formed by annular slots which extend entirely through the conductive layer 34 that defines the ground plane 35. Each ring 55 and 56 is not continuous, but has a gap 57 or 58 in the respective slot which gap is created by a portion of the conductive layer 34. The gap 57 in the slot of the inner ring 55 is oriented 180° from the gap 58 in the slot of the outer ring 56. In other words, the gap is on a side of one ring that is opposite to a side of the other ring on the other gap is located.

The metal-dielectric structure 51-54 can be modeled as an inductor-capacitor network that forms tuned circuit which provides a frequency selective surface. The metal-dielectric structures are designed to have a specific frequency stop band that reflects radio frequency signals or prohibits the transmission of signals at that frequency band. The maximum dimensions of each structure may be about one-tenth of the free space wavelength of the operating frequency of the antenna. If each of the first and second antennas 41 and 42 function at a single frequency, i.e. not be dynamically tunable, then the metal-dielectric structures can have a fixed stop band that includes the radio frequencies of the signals to be transmitted and received by the adjacent antenna 41 or 42.

The placement of one or more metal-dielectric resonant structures at such locations adjacent the antenna enables the antenna to have a physical size that is not its resonant length at the operating frequency of the signal applied by the radio frequency transceiver 28. In some embodiments, these structures enable the antenna to be physically shorter than the resonant length and still efficiently transmit or receive the radio frequency signal. The metal-dielectric structures, however, alter the resonant frequency of the antenna so that the antenna has an effective electrical length which is longer than the physical length and thus is tuned to the wavelength of the RF signal from the radio frequency transceiver 28. In other words, although the physical size of the antenna that is much smaller than its resonant length, interaction with the metal-dielectric structures 51-54 causes the antenna to function as through its physical size is equal to its resonant length at the operating frequency.

If the first and second antennas 41 and 42 are intended to transmit and receive signal at different radio frequencies, then the metal-dielectric structures can be dynamically tunable so that the structures still alter the resonant frequency of the adjacent antenna. One way of accomplishing that dynamic tuning or configuration of an antenna is to place one or more switches 59 at selected locations across one of both of the slots of the metal-dielectric structure. Each switch 59, for example, may be a microelectromechanical system (MEMS) that is controlled by a signal from the tuning control 29. When closed, the respective switch 59 provides an electrical path between the across the slot thereby altering the electrical length of the ring 55 or 56. Such alteration changes the resonant frequency of the metal-dielectric structure and thus also the frequency to which the associated antenna is tuned.

Figure 4:
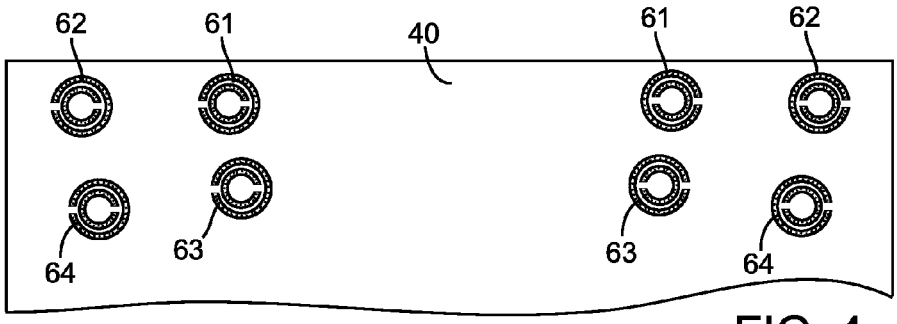
FIG. 4 is an enlarged view of a portion of the opposite side of a printed circuit board showing an alternative arrangement of metal-dielectric structures.

FIG. 4 illustrates an alternative placement of the metal-dielectric structures for the antennas 41 and 42 in FIG. 2. Instead of placing the sets of metal-dielectric structures 51-54 on the ground plane near the antennas, a set of metal-dielectric structures 61, 62, 63 and 64 is located on the opposite second major surface 40 of the printed circuit board 32. Thus the metal-dielectric structures 61-64 are formed on a non-conductive surface of the substrate 31 underneath the first and second antennas 41 and 42. As with the placement of the structures 51 and 54, each of these metal-dielectric structures 61-64 is located at a position where the current density in the substrate 31, as determined from the antenna emission pattern, is greater than a given threshold level.

Figure 6:
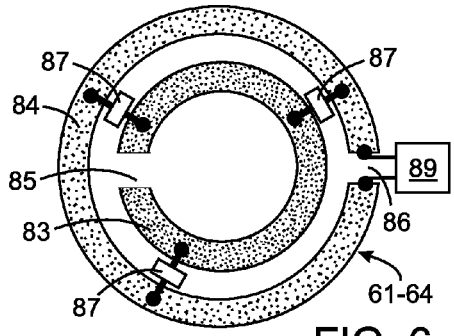
FIG. 6 depicts one of the metal-dielectric structures in FIG. 4.

As shown in detail in FIG. 6, each metal-dielectric structure 61-64 is formed by a frequency selective surface structure having a pair of concentric rings 83 and 84 of metal that is deposited on that second major surface 40. The inner ring 83 has a gap 85 that is diametrically opposite to the gap 86 in the outer metal ring 84. several switches 87 are placed between the two rings 83 and 84 of the metal-dielectric structure at selected radial locations. Each switch 87 may be a microelectromechanical system (MEMS), for example, that is controlled by a signal from the tuning control 29. When closed, a respective switch 87 provides an electrical path between the inner and outer rings 83 and 84. A tuning circuit 89 can be connected across the gap of one of the two rings instead of using the switches 87.

Figure 7:
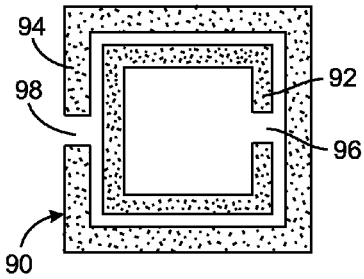
FIG. 7 illustrates a first alternative embodiment of a metal-dielectric structure.

Although the metal-dielectric structures 51-54 and 61-64 in FIGS. 2-4 are implemented utilizing circular ring resonators, other types of resonant cells may be employed. For example as shown in FIG. 7, an alternative metal-dielectric structure 90 has inner and outer rectilinear, e.g. square, rings 94 and 92. If these rings are on the second major surface of the substrate, that is opposite from the ground plane conductive layer, the rings are formed by metal strips, whereas the rings are slots when located on the ground plane conductive layer. Each rectilinear ring 92 and 94 has a gap 96 and 98, respectively, with the gap on one ring being on the opposite side from the gap on the other ring. Another type of metal-dielectric structure is formed by a single slotted ring similar to outer ring 56 in FIG. 5, outer ring 84 in FIG. 6, or ring 94 in FIG. 7.

Figure 8:
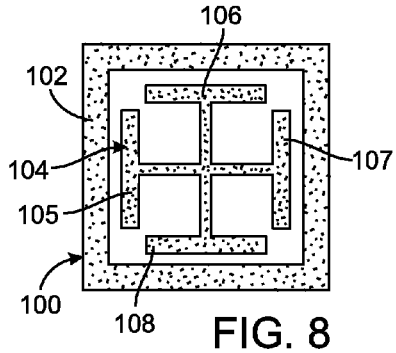
FIG. 8 illustrates a second alternative embodiment of a metal-dielectric structure.

FIG. 8 denotes another configuration of a metal-dielectric structure 100 that can be used as a resonant tuning cell. This structure 100 is an electromagnetic band gap device that has a square ring 102 that is continuous and does not have a gap. Within the square ring 102 is an interior element 104 having a shape of a Jerusalem cross. Specifically the interior element has four T-shaped members 105, 106, 107 and 108, each having a cross section extending parallel to and spaced from one side of the square ring 102. Each T-shaped member 105-108 has a tie section that extends from the respective cross section to the center of the square ring 102 at which point all the T-shaped members are electrically connected. Switches can be connected at various locations between the T-shaped members 105, 106, 107 and 108 and the square ring 102 to dynamically tune the resonate frequency of the metal-dielectric structure 100.

Figure 9:
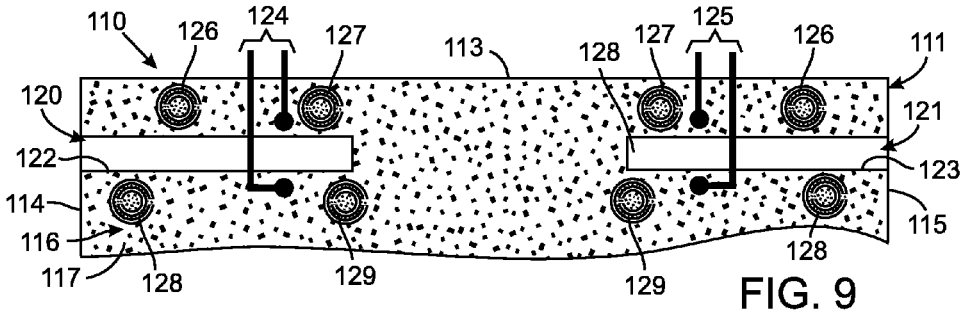
FIG. 9 is an enlarged partial view of one side of a printed circuit board with slot type antennas.

FIG. 9 depicts a second antenna assembly 110 in which the first and second antennas 120 and 121 have radiating elements formed by slots 122 and 123, respectively, in a ground plane 117. The physical length of each slot 122 and 123 is not equal to the resonant length of the antennas 122 and 123, which the resonant length is one-fourth the wavelength of the radio frequency signal that is applied to the antennas by the radio frequency transceiver 28 operating in a transmitting mode. For example, the physical length of each slots 122 and 123 may be least than one-fourth that wavelength. In this embodiment, a printed circuit board 111 that has a non-conductive substrate 112 with three adjacent edges 113, 114 and 115. A conductive layer 116 forms the ground plane 117 on a first major surface of the substrate 112. The first and second open-ended slots 122 and 123 extend through the conductive layer 116 beginning at the opposite edges 114 and 115. The slots have interior closed ends that are spaced apart by a portion of the conductive layer 116. Each antenna 120 or 121 has a separate signal port 124 or 125 to which a radio frequency signal from the radio frequency transceiver 28 is applied to excite the respective antenna.

A plurality, in this instance four, metal-dielectric structures 126, 127, 128 and 129 are located around each antenna slot 122 and 123. Each of these metal-dielectric structures 126-129 is formed by a pair of concentric rings and has the same formation as the metal-dielectric structure shown in FIG. 5.

Without the metal-dielectric structures 126-129, the physical length of each antenna slot 122 and 123 typically would be one-quarter of the wavelength of the radio frequency signal for which the antenna is desired to operate. The metal-dielectric structures, however enable the length of each antenna slot 122 and 123 to be substantially less than one-quarter of the wavelength, e.g. 60% of one-quarter of the wavelength.

Figure 10:
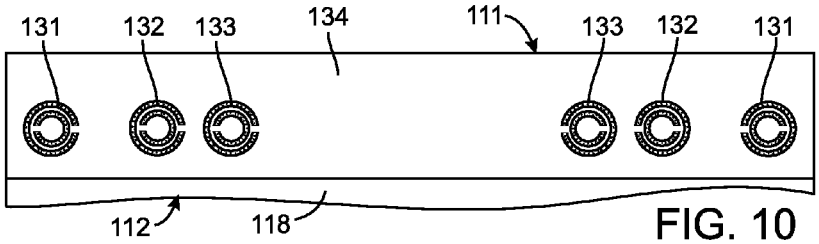
FIG. 10 is an enlarged view of a portion of the opposite side of a printed circuit board showing an alternative arrangement of metal-dielectric structures for a slot type antenna.

Alternatively, instead of placing the metal-dielectric structures on the ground plane 117, sets of metal-dielectric structures 131, 132 and 133 are formed on the opposite second major surface 118 of the printed circuit board 111 as illustrated in FIG. 10. These metal-dielectric structures 131-133 may be located directly beneath the slots 122 and 123 of the first and second antennas 120 and 121. In this instance, each metal-dielectric structure 131-133 is formed by a pair of concentric rings of metal with the same configuration as shown in FIG. 6. Nevertheless, the metal-dielectric structures in FIGS. 7 and 8 may be used instead. As noted previously single slotted ring metal-dielectric structures also can be used.

The metal-dielectric structures 131-133, however, do not have the switches between the concentric rings and employ a different tuning mechanism. The metal-dielectric structures 131-133 are formed on a layer 134 of a liquid crystal polymer that is deposited upon the opposite major surface 118 of the printed circuit board substrate 112. In this embodiment, the concentric rings form the metal portion of each metal-dielectric structure 131-133 with the substrate 112 and the liquid crystal polymer layer 134 forming the dielectric component of the structure. Liquid crystal polymers have a dielectric characteristic that changes in response to variation of a DC voltage applied thereto. Therefore, when the radio frequency transceiver 28 applies a signal with a different radio frequency to the first or second antenna 120 or 121, a control signal is sent to the tuning control 29 which responds by which applying a DC voltage that biases the liquid crystal polymer layer 134 with respect to the ground plane 117. This biasing alters the dielectric characteristic of the metal-dielectric structures 131-133 and their stop band frequencies, thereby changing the electrical size and the resonant frequency of the first and second antennas 120 and 121. As illustrated a single liquid crystal polymer layer 134 extends beneath the metal-dielectric structures 131-133 for both antennas. Alternatively, a separate liquid crystal polymer layer can be placed under the set of metal-dielectric structures for each antenna or a separate liquid crystal polymer layer can be formed under each individual metal-dielectric structure.

In both embodiments depicted in FIGS. 9 and 10, the metal-dielectric structures 126-129 and 131-133 enable the adjacent antenna slot 122 or 123 to have a physical length that is not one-fourth the wavelength of the radio frequency signals applied by the radio frequency transceiver 28. In some instances, those structures enable the antenna to be physically shorter than one-fourth that wavelength and still efficiently transmit or receive the radio frequency signal. The metal-dielectric structures, however, alter the electrical length and thus the resonant frequency of the antenna so that the antenna has an effective electrical length that is longer than the physical length. Thus the antenna is tuned to the wavelength of the RF signal from the radio frequency transceiver 28.

Figure 11:
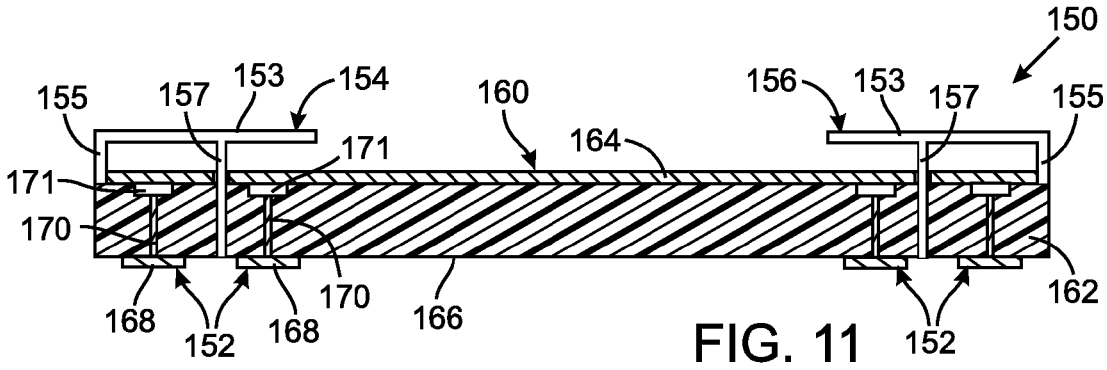
FIG. 11 is a cross sectional view through a printed circuit board that has yet another type of metal-dielectric structures.

FIG. 11 illustrates another embodiment of an antenna assembly 150 that incorporates a further type of metal-dielectric structures 152. This antenna assembly 150 includes first and second inverted F type antennas 154 and 156 mounted on a printed circuit board 160. The printed circuit board 160 comprises a substrate 162 of dielectric material with a first major surface that has a layer 164 of electrically conductive material thereon, thereby forming a ground plane.

The first and second antennas 154 and 156 are disposed on the same surface of the substrate 162 as the electrically conductive layer 164. Each antenna has a first leg 153 parallel to and spaced from the conductive layer 164. A second leg 155, that forms a shorting pin, is connected between the conductive layer and the first leg 153. Each antenna 154 and 156 has a third leg 157, forming a feed connection, to which a radio frequency signal is applied by the transceiver 28 to excite the respective antenna. The length of the antenna 154 or 156 is the combined lengths of the radiating element 153 summed with length (or height) of the first leg 155.

One or more metal-dielectric tuning structures 152 are provided that enable the length of the first and second antennas 154 and 156 to be less than one-fourth the wavelength of the radio frequency signals transmitted or received by the antenna, which is the resonant length of the antenna. Each of these metal-dielectric tuning structures 152 is a "mushroom" type electromagnetic band gap device comprising a patch style metal pattern 168 formed on the opposite surface 166 of the printed circuit board from the antennas 154 and 156. The metal pattern alternatively may be one of the resonant cells previously described herein, however in this instance the metal pattern 168 is connected to a via 170.

The metal-dielectric structure 152 is dynamically tuned to alter the electrical length and the resonant frequency of the associated antenna 154 or 156. That dynamically tuning is accomplished by the tuning control 29 operating a switch 171, such as a MEMS, for example, that selectively connects the via 170 to the electrically conductive layer 164.

It should be appreciated that more than one such metal-dielectric structures 152 can be employed in this antenna assembly, depending upon the locations of high current density regions around and underneath the two antennas 154 and 156.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a wireless communication device that produces a radio frequency signal, said antenna assembly comprising:

a substrate of dielectric material and having a first surface and a second surface;

a ground plane formed by a layer of electrically conductive material on the first surface;

an antenna disposed on the substrate proximate to the ground plane and having a structure that is resonant at a first frequency, wherein the antenna has a port for receiving the radio frequency signal; and at least one metal-dielectric structure disposed proximate to the antenna and resonating at a given frequency, wherein each metal-dielectric structure is located at a position at which an electric current produced by a signal from the antenna has a current density greater than eighty percent of a maximum current density level resulting from the signal, and wherein the at least one metal-dielectric structure alters resonance of the antenna to resonate at a second frequency instead of the first frequency.

2. The antenna assembly as recited in claim 1 wherein each metal-dielectric structure comprises a pattern of slots in the layer of electrically conductive material.

3. The antenna assembly as recited in claim 1 wherein each metal-dielectric structure comprises a pattern of metal on the second surface of the substrate.

4. The antenna assembly as recited in claim 1 wherein the at least one metal-dielectric structure comprises a pattern of electrically conductive material on a surface of a dielectric body.

5. An antenna assembly for a wireless communication device that produces a radio frequency signal, said antenna assembly comprising:

a substrate of dielectric material and having a first surface and a second surface;

a ground plane formed by a layer of electrically conductive material on the first surface;

an antenna disposed on the substrate proximate to the ground plane and having a structure that is resonant at a first frequency, wherein the antenna has a port for receiving the radio frequency signal; and at least one metal-dielectric structure disposed proximate to the antenna and resonating at a given frequency, wherein each metal-dielectric structure comprises an electrically conductive pattern on the second surface of the substrate, a via connected to the electrically conductive pattern, and a switch coupling the via to the layer of electrically conductive material on the first surface, and wherein the at least one metal-dielectric structure alters resonance of the antenna to resonate at a second frequency instead of the first frequency.

6. An antenna assembly for a wireless communication device that produces a radio frequency signal, said antenna assembly comprising:

a ground plane;

an antenna disposed proximate to the ground plane and having a structure that is resonant at a first frequency, wherein the antenna has a port for receiving the radio frequency signal; and at least one metal-dielectric structure disposed proximate to the antenna and resonating at a given frequency, wherein each metal-dielectric structure comprises a pair of concentric rings each having a gap, and wherein the at least one metal-dielectric structure alters resonance of the antenna to resonate at a second frequency instead of the first frequency.

7. The antenna assembly as recited in claim 6 further comprising a layer of liquid crystal polymer between the substrate and the at least one metal-dielectric structure for dynamically varying the given frequency at which the at least one metal-dielectric structure resonates.

8. The antenna assembly as recited in claim 6 wherein the gap is on a side of one ring that is opposite to a side of the other ring at which another gap is located.

9. The antenna assembly as recited in claim 6 wherein the pair of concentric rings are either circular or rectilinear.

10. The antenna assembly as recited in claim 6 further comprising a switch for selectively creating an electrical path between the pair of concentric rings that alters the given frequency of the at least one metal-dielectric structure.

11. The antenna assembly as recited in claim 6 further comprising a device for dynamically varying the given frequency of the at least one metal-dielectric structure.

12. An antenna assembly for a wireless communication device that produces a radio frequency signal, said antenna assembly comprising:

a ground plane;

an antenna disposed proximate to the ground plane and having a structure that is resonant at a first frequency, wherein the antenna has a port for receiving the radio frequency signal; and at least one metal-dielectric structure disposed proximate to the antenna and resonating at a given frequency, wherein each metal-dielectric structure comprises a rectilinear ring within which is an element shaped like a Jerusalem cross, and wherein the at least one metal-dielectric structure alters resonance of the antenna to resonate at a second frequency instead of the first frequency.

13. An antenna assembly for a wireless communication device comprising:

a substrate of dielectric material and having a first surface and a second surface on opposite sides of the substrate;

a ground plane formed by a layer of electrically conductive material on the first surface;

an antenna disposed on the substrate and having a physical length; and a plurality of metal-dielectric structures forming a non-periodic array disposed on the substrate, wherein each metal-dielectric structure interacts with the antenna wherein as a result the antenna has an effective electrical length that is greater than the physical length.

14. The antenna assembly as recited in claim 13 wherein each of the plurality of metal-dielectric structures is located at a position at which an electric current density greater than a predefined threshold.

15. The antenna assembly as recited in claim 13 wherein each of the plurality of metal-dielectric structures comprises a pattern of slots in the layer of electrically conductive material.

16. The antenna assembly as recited in claim 15 further comprising a switch for selectively creating an electrical path across a slot in the pattern.

17. The antenna assembly as recited in claim 13 wherein each of the plurality of metal-dielectric structures comprises a pattern of metal on the second surface of the substrate.

18. The antenna assembly as recited in claim 13 wherein each of the plurality of metal-dielectric structures comprises a pair of either circular or rectilinear concentric rings, each having a gap.

19. The antenna assembly as recited in claim 18 wherein the gap is on a side of one ring that is opposite to a side of the other ring at which another gap is located.

20. The antenna assembly as recited in claim 18 wherein each of the plurality of further comprises a switch for selectively creating an electrical path between the pair of concentric rings.

21. The antenna assembly as recited in claim 13 wherein each of the plurality of metal-dielectric structures comprises a rectilinear ring within which is an element shaped like a Jerusalem cross.

22. The antenna assembly as recited in claim 13 further comprising a device for varying a resonate frequency of each of the plurality of metal-dielectric structures.

23. The antenna assembly as recited in claim 13 further comprising a layer of liquid crystal polymer between the substrate and the plurality of metal-dielectric structures for dynamically varying a frequency at which the plurality of metal-dielectric structures resonates.

* * * * *